United States Patent [19]

Commander et al.

[11] Patent Number: 5,061,351

[45] Date of Patent: Oct. 29, 1991

[54] BRIGHT TIN ELECTRODEPOSITION COMPOSITION

[75] Inventors: John H. Commander, Old Saybrook; Vincent Paneccasio, Jr., Madison, both of Conn.

[73] Assignee: Enthone-OMI, Inc., West Haven, Conn.

[21] Appl. No.: 555,690

[22] Filed: Jul. 23, 1990

[51] Int. Cl.[5] ..... C25D 3/30

[52] U.S. Cl. ..... 204/54.1; 204/44.4

[58] Field of Search ..... 204/54.1, 44.4

[56] References Cited

U.S. PATENT DOCUMENTS 4,000,047 12/1976 Ostrow et al. ..... 204/54.1 X 4,139,425 2/1979 Eckles et al. ..... 204/54.1 X

*Primary Examiner*—John F. Niebling

*Assistant Examiner*—Steven P. Marquis

*Attorney, Agent, or Firm*—John J. Tomaszewski

[57] ABSTRACT

A vinyl-pyridine or vinyl-quinoline quaternary derivative is provided to enhance the brightness and operating properties of tin aqueous sulfuric acid plating baths.

11 Claims, No Drawings

BRIGHT TIN ELECTRODEPOSITION COMPOSITION

BACKGROUND OF THE INVENTION

This invention relates to metal electrodeposition and more specifically to acid tin electrodeposition baths containing special brightener additive materials.

Acid tin electroplating baths for producing bright tin deposits are well-known and disclosed in the prior art such as U.S. Pat. No. 3,709,799, which patent is incorporated herein by reference. These baths generally contain sulfate, alkyl sulfonate or fluoroborate ions, a reducing agent such as formalin, a non-ionic surfactant, and as brightening agents an aromatic or heterocyclic ring-containing aldehyde wherein the carbonyl group is directly attached to the aromatic or heterocyclic ring or $\alpha$, $\beta$-olefinically unsaturated carbonyl compound, such as benzalacetone. Other known brightening agents include 2-furylmethylketone and 1-naphthaldehydes. Secondary brighteners include polymerizable organic compounds capable of reducing the overvoltage for the evolution of hydrogen at a tin cathode such as acrylic acid, 2-vinyl pyridine, tetrahydrofuran and vinyl acetate.

Acid bright tin electroplating baths also known in the prior art contain a primary brightener of the formula X—CH=CH—Y wherein X is phenyl, furfuryl or pyridyl and Y is hydrogen, formyl, carboxyl, alkyl, hydroxyalkyl, formylalkyl, or the acyl radical of a carboxylic acid. Formaldehyde and certain imidazoline derivatives serve as secondary brighteners in such baths, especially when employed with non-ionic wetting agents.

A number of baths and additives are shown in U.S. Pat. Nos. 4,000,047 and 4,139,425, which are incorporated herein by reference.

U.S. Pat. No. 4,000,047 is directed to the electrodeposition of tin-lead alloys from aqueous acid fluoroborate, sulfamate and silicofluoride systems using pyridine and quinoline compounds as brighteners. The disclosed brighteners have no effect or a minimal effect in the acid-tin baths of the invention and, in some cases, have a deleterious effect. Only the 2-vinylpyridine-N-oxide disclosed at column 7 of the '047 patent is effective in applicants' tin—$H_2SO_4$ bath.

Tin—$H_2SO_4$ plating baths are important commercially and it is desirable that the quality and clarity of the tin deposit be improved. Also important is to increase the temperature range and operating life of the bath.

The present invention has among its objects the provision of an additive for sulfuric acid tin electroplating baths to provide enhanced plating performance and brightening effects, among other benefits.

A further object is to provide a method for tin electroplating using the baths of the invention.

Other objects and advantages will be apparent from the following description.

SUMMARY OF THE INVENTION

It has now been discovered that sulfuric acid tin electroplating baths, including commercial sulfuric acid-tin baths containing conventional brightening additives, may be improved by using as an additive in the bath an effective amount of a quaternized derivative of vinylpyridine or vinyl-quinoline of the general formula

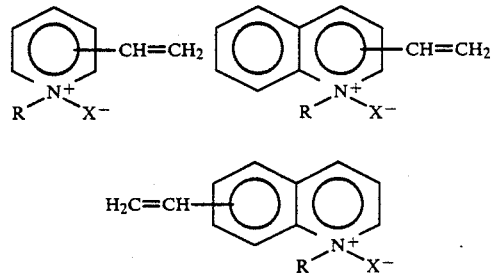

where R may be alkyl, alkenyl, alkynyl, aryl, alkyl phenyl, phenyl, alkyl napthalene and alkyl sulfonate radicals. The R groups, including the pyridine and quinoline rings, may have specific substituting groups such as halogen, nitro, nitroso, hydroxy, alkoxy, carboxy, cyano, sulfo, ester, methyl, ethyl, etc. X represents an anion or anionic linkage such as halogen or anions derived from the use of alkylating agents such as alkyl and aryl halides, sulfates, and the like such as methyl chloride, dimethyl sulfate, methyl-p-toluene sulfonate, peroxide, epichlorohydrin, benzyl chloride and propane sultone. In general, the alkyl, alkenyl and alkynyl groups are lower radicals such as $C_1$–$C_8$, preferably $C_1$–$C_3$.

DETAILED DESCRIPTION OF THE INVENTION

The tin plating baths are preferably sulfate baths wherein the free acid is sulfuric acid and the tin or stannous ion is supplied by stannous sulfate. In general, the concentration of metal ions in the bath may vary widely between about 5 to 350 grams per liter (g/l) and preferably about 15 to 60 g/l. The pH of the bath is generally less than about 1 and the acid concentration is usually about 90 to 270 g/l, preferably 140 to 220 g/l.

The above-described brightener additive is added to the acid plating baths of the invention in an amount which is sufficient and effective to produce a smooth and bright tin deposit on the substrate, and generally is in a range of about 0.01 to about 0.1 g/or higher and preferably about 0.02 to about 0.05 g/l of the bath. The preferred additive is a 2-position vinyl pyridine or quinoline quaternized derivative.

The above-described brightener additives may be prepared by reacting an aqueous or alcohol-water (e.g., up to 10% alcohol or higher) mixture of the vinyl pyridine or vinyl quinoline compound with an alkylating agent usually at elevated temperatures. For example, to prepare the preferred 1-methyl-2-vinyl-pyridinium-p-toluene sulfonate compound (MVPTS), an alcohol-methyl-p-toluene sulfonate mixture is slowly added to a 2-vinyl-pyridine aqueous mixture over a period of 1–2 hours at about 90° C. The mixture may be separated and purified or used as the reaction product mixture. Generally about a 75–80% molar conversion is obtained in the reaction and it is preferred to use a slight molar excess of the alkylating agent, e.g., 5–25%.

Other exemplary pyridine derivatives are 2-vinylpyridine N-oxide; 1-$CH_3$-2-vinylpyridinium methane sulfonate; 1-(3-chloro-2 hydroxy-propyl) 2-vinyl pyridinium chloride; 1-$CH_3$-2 vinyl quinolinium methosulfate; and 1-(3-sulfo propyl) 2-vinylpyridinium betaine.

It is a preferred feature of the invention that the pyridine and quinoline derivative additives be empolyed in otherwise conventional (e.g., commerical) tin plating baths already containing brighteners since the combination of the additive and the brighteners in the conventional bath provides a synergistic enhanced brightening and operating effects greater than if the brightener additives are used separately. Further, the conventional baths have now been found to have a longer operating life and may be employed over a wider temperature range. Thus, the addition of 0.03 g/l of MVPTS to ENTHOBRITE TIN 899, 6652 and 4773 commerical baths sold by Enthone, Incorporated, West Haven, Connecticut, greatly improved the performance of the baths.

In general, the properties of the tin deposited by the baths of the invention and their operating performance may be enhanced further by including other additives in the bath. For example, the brightness of the deposit is generally improved if the bath contains at least one carbonyl compound (aldehyde and/or ketone). Thus, the plating baths of the invention may contain at least one aldehyde which may be an aliphatic aldehyde, an aromatic aldehyde, or mixtures of such aldehydes. The aliphatic aldehydes which are particularly useful in the plating baths of the invention include, for example formaldehyde, acetaldehyde, propionaldehyde, butyraldehyde, crotonaldehyde, and 3-hydroxy-butyraldehyde. Up to about 5 g/l or higher of the aliphatic aldehyde may be included in the bath and preferably, about 1 to 3 g/l of the aliphatic aldehyde is utilized.

Preferred examples of the aromatic aldehydes which have been found useful are the naphthaldehydes and benzaldehydes. Examples of other carbonyl compounds include ketones which may include aliphatic ketones such as acetone and methyl ethyl ketone, and aromatic ketones such as benzylidene acetone, coumarin, acetophenone, propiophenone, 3-methoxybenzalacetone. The amount of aromatic aldehyde or other carbonyl containing compound included in the baths of the invention will range up to about 5 g/l and preferably is about 0.001 to 0.1 g/l and most preferably 0.01 to 0.05 g/l.

Other suitable brightener additives may be included in the bath.

The incorporation of one or more wetting or surface active agents into the plating baths of the invention results in a tin plating with improved leveling and brightness and the additive composition and plating baths exhibit improved stability. Wetting agents based on ethylene and propylene oxide (polyalkylene oxides), for example, polyglycol compounds such as TRITON X-100 and the like, and sulfonated wetting agents are useful at levels of about 1 to 25 g/l and preferably at about 3–5 g/l of the bath.

The acid tin plating baths of the present invention deposit a level bright coating of the metal on substrates at the conventional temperatures used with tin plating baths, (usually room temperature to 40° C.) and over a wide current density range such as from 2 to 2000 amperes per square foot (ASF), usually 2 to 120 ASF or 2 to 30 ASF.

The following examples illustrate the plating baths of the invention containing the pyridine and quinoline derivative additive compositions. Unless indicated, all parts and percentages are by weight and temperatures in .C.

1-methyl-2-vinyl-pyridinium-p-toluene sulfonate (MVPTS) was prepared by forming a mixture of 2700 grams water and 600 grams 2-vinyl-pyridine and adding dropwise to this mixture over a period of 1–2 hours at about 90° C. a mixture of 1140 grams methyl-p-toluene sulfonate and 150 ml ethanol. The reaction mixture was then diluted with water to a final volume of 12 liters and this material was used in the following examples. A molar conversion of about 75% was achieved.

All the examples were carried out in a 267 ml Hull cell, a trapezoidal box of nonconducting material having the electrodes so arranged that a single plating experiment will provide a range of current densities from which optimum plating conditions can be conveniently determined. All tests were conducted or operated at room temperature with mild agitation.

An aqueous stock solution of $SnSO_4$ (24 g/l) and concentrated $H_2SO_4$ 9.7% (by volume) was prepared and used to make the following baths.

EXAMPLE 1

A plating bath was prepared by adding 1 gram Triton X-100, 0.01 gram methacrylic acid and 0.01 gram of benzylidene acetone to 267 ml of the stock solution. A steel cathode was plated at 2 amperes for 5 minutes. The deposit was grain refined but showed no brightness in the 0.5 to 20 ASF range.

When 0.09 ml (0.03 g/l) of the MVPTS reaction mixture was added to the same composition bath the deposit was extremely bright in the range of 0.5 to 24 ASF.

EXAMPLE 2

Example 1 was repeated except that the bath was prepared by adding 1 g Triton X-100, 0.01 g acrylic acid and 0.006 g 1-naphthaldehyde to 267 ml of the stock solution. A steel cathode plated at 2 amps for 5 minutes produced a bright and grain refined deposit from 0.5–80 ASF. Addition of 0.06 ml (0.02 g/l) of the reaction mixture to the same composition bath greatly enhanced the brightness and leveling of the deposit over the same current density range.

EXAMPLE 3

Example 1 was repeated except that the bath was prepared by adding 1 g Igepal CO 730, 0.01 g methacrylic acid and 0.01 g acrylic acid to 267 ml of the stock solution. A steel cathode was plated for 5 minutes at 2 amps and the deposit was gray and lacked brightness over the whole current density range of 1 to 80 ASF. Grain refinement above 12 ASF was poor. When 0.06 ml (0.02 g/l) of the reaction mixture was added to the same composition bath a grain refined semi-bright plating was obtained over the entire current density of 1 to 80 ASF.

EXAMPLE 4

Various compounds of U.S. Pat. No. 4,000,047 supra were tested as in EXAMPLE 1 and 0.06 g/l of the specified additive was added to 267 ml of the stock solution. The compounds tested were 2-carboxypyridine; nicotinic acid: 3-carboxy 1-benzyl pyridinium chloride; and 2-vinyl pyridine. None of the compounds were commercially satisfactory. These results demonstrate the comparative effectiveness of the compounds of the invention such as MVPTS.

EXAMPLE 5

The following compounds of the invention were tested as shown in the above examples and all produced tin deposits which were bright and commercially acceptable: 2-vinyl-pyridine N-oxide; 1-$CH_3$-2-vinyl-pyridinium methane sulfonate; 1-(3-Chloro-2 hydroxy-propyl) 2-vinyl pyridinium chloride; 1-$CH_3$-2 vinyl quinolinium methosulfate; and 1-(3-sulfo propyl) 2-vinylpyridinium betaine.

While the invention has been directed to tin—$H_2SO_4$ baths, it will be understood that the disclosed additives and processes are applicable to other acid containing tin plating baths such as fluoborate, sulfamate, and alkyl sulfonate and that such other embodiments are, therefore, also embraced within the scope of the present invention.

It will be apparent that many changes and modifications of the several features described herein may be made without departing from the spirit and scope of the invention. It is therefore apparent that the foregoing description is by way of illustration of the invention rather than limitation of the invention.

We claim:

1. In an aqueous non-lead sulfuric acid-tin electroplating bath the improvement comprising including in the plating bath for enhanced brightness a quaternized derivative of a substituted or unsubstituted vinyl-pyridine or vinyl-quinoline compound of the general formula

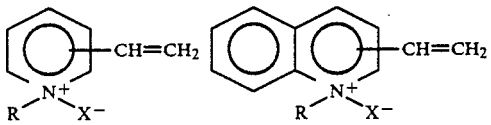

-continued

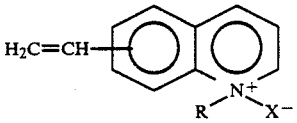

where R is selected from the group consisting of substituted or unsubstituted alkyl, alkenyl, alkynyl, aryl, alkyl phenyl, phenyl, alkyl napthalene and alkyl sulfonate radicals and the substituting groups are selected from the group consisting of halogen, nitro, nitroso, hydroxy, alkoxy, carboxy, cyano, sulfo, ester, methyl and ethyl; and X represents an anion or anionic linkage selected from the group consisting of halogen and anions derived from the use of methyl chloride, dimethyl sulfate, methyl-p-toluene sulfonate, peroxide, epichlorohydrin, benzyl chloride and propane sultone alkylating agents.

2. The plating bath of claim 1 wherein R is an alkyl group of 1 to 8 carbon atoms.

3. The plating bath of claim 2 wherein the alkyl group is methyl.

4. The plating bath of claim 3 wherein X is p-toluene sulfonate.

5. The plating bath of claim 3 wherein the vinyl group of the vinyl-pyridine or vinyl-quinoline is at the 2-position.

6. The plating bath of claim 1 wherein the plating bath contains additional brightening agents selected from the group consisting of aliphatic aldehydes, aromatic aldehydes and ketones.

7. The plating bath of claim 6 wherein R is an alkyl group of 1 to 8 carbon atoms.

8. The plating bath of claim 7 wherein the alkyl group is methyl.

9. The plating bath of claim 8 wherein X is p-toluene sulfonate.

10. A method for the electrodeposition of bright tin comprising utilizing the bath of claim 1.

11. The plating bath of claim 1 wherein the vinyl group of the vinyl-pyridine or vinyl-quinoline is at the 2-position.

* * * * *